US010865961B1

(12) United States Patent
Simon

(10) Patent No.: US 10,865,961 B1
(45) Date of Patent: Dec. 15, 2020

(54) LIGHTING SYSTEMS CONTAINING STRUCTURAL OPTICAL COMPONENTS

(71) Applicant: Jerome H. Simon, Watertown, MA (US)

(72) Inventor: Jerome H. Simon, Watertown, MA (US)

( * ) Notice: Subject to any disclaimer, the term of this patent is extended or adjusted under 35 U.S.C. 154(b) by 0 days.

(21) Appl. No.: 16/274,029

(22) Filed: Feb. 12, 2019

Related U.S. Application Data

(60) Provisional application No. 62/710,195, filed on Feb. 12, 2018.

(51) Int. Cl.

| | |
|---|---|
| ***F21V 14/02*** | (2006.01) |
| ***F21V 5/04*** | (2006.01) |
| ***F21V 29/70*** | (2015.01) |
| ***F21V 19/02*** | (2006.01) |
| *F21Y 115/10* | (2016.01) |
| *F21Y 103/10* | (2016.01) |

(52) U.S. Cl.
CPC ..... *F21V 14/02* (2013.01); *F21V 5/043* (2013.01); *F21V 19/02* (2013.01); *F21V 29/70* (2015.01); *F21Y 2103/10* (2016.08); *F21Y 2115/10* (2016.08)

(58) Field of Classification Search
CPC ..... F21V 14/02; F21V 29/70; F21V 5/043; F21V 19/02; F21Y 2103/10
See application file for complete search history.

(56) References Cited

U.S. PATENT DOCUMENTS

| | | | | |
|---|---|---|---|---|
| 5,130,908 | A * | 7/1992 | Simon | E04B 9/04 362/147 |
| 6,784,603 | B2 * | 8/2004 | Pelka | B82Y 10/00 313/110 |
| 2006/0002110 | A1 * | 1/2006 | Dowling | F21K 9/00 362/249.05 |
| 2011/0075441 | A1 * | 3/2011 | Swessel | B65G 69/008 362/554 |
| 2015/0260935 | A1 * | 9/2015 | Williams | F21V 33/006 362/217.14 |
| 2017/0074486 | A1 * | 3/2017 | Flynn | F21V 5/02 |

* cited by examiner

*Primary Examiner* — Anabel Ton
(74) *Attorney, Agent, or Firm* — Burns & Levinson LLP; Jerry Cohen

(57) ABSTRACT

A lighting device uses a cylindrical lens with LED light sources positioned and adjustable with respect to the cylindrical lens.

20 Claims, 7 Drawing Sheets

OS
LED
LE
FD
RL
BF

OS
RL
AX
LL
LED
ST
FB

OS
RL
B
LL1
ST
LED
LL2
FB
ST
LED

LL3
ST
LED
LE
BF
RM
AX
IAX
LL P1
RL P2
AX
P3
P4
RA
FIG 1-C

OS

RL
LL2
LED 2
LED 1
LL1
LL3
LED 3
OS

RL
LL1
LED 1
LED 2
LL2
OS

RL
LL
ST
LED 3

VS
WB
LL1
RL
LL2
WR
SW
CP
LL3
LL4
LL5
LL6
LF
RL1
RL2
RL3
RA
BX
BY

LIGHTING SYSTEMS CONTAINING STRUCTURAL OPTICAL COMPONENTS

CROSS REFERENCE TO RELATED APPLICATIONS

This application claims priority from U.S. Provisional Patent Application Ser. No. 62/710,195, filed Feb. 12, 2018 and incorporated herein by reference in its entirety.

FIELD OF THE INVENTION

The present invention generally relates to lighting devices, and in particular to such devices which incorporate Light Emitting Diodes.

SUMMARY OF THE INVENTION

One embodiment of the present invention provides an optical system capable of distributing light in multiple directions simultaneously, the optics of which having structural space spanning capabilities, comprising: at least one rod lens; at least one linear light source; an electrical continuity and distribution system; the at least one rod lens substantially fabricated from clear optical material and shaped in the form of a solid cylinder, the rod lens having an axis running central to the cylindrical surface, the function of the rod lens having the power to collect, focus, and project light from a light source as a beam focused in a single degree of freedom, the focus of the beam being parallel to the central optical axis of the rod lens; the at least one linear light source containing an LED strip containing at least two LEDs mounted to a heat dissipation substrate, the linear light source disposed along at least a portion of the length of the rod lens, the linear light source containing an attachment mechanism to connect the light source to the rod lens for maintaining the focal distance between the light emanating from the surface of the LEDs and the central axis of the rod lens, the attachment mechanism containing a mechanical element to provide angular adjustment for the light source to be positioned around the rod lens, while also providing linear positioning of the light source along the length of the rod lens; the electrical system supplies electrical continuity to the LEDs, the electrical system designed to maintain electrical continuity to and between the linear light sources when the angular and linear positioning of the light source(s) are changed in respect to the Rod Lens.

The optical system may include the attachment mechanism of the linear light source(s) containing a mechanical element providing the linear light source to be positioned around the central axis of the rod lens while maintaining the distance between the light emanating surface of the LEDs and the central axis of the rod lens, and providing continuous electrical continuity to the linear light sources.

The optical system may include at least two linear light sources, each disposed at different positions along the length of the lens, the attachment element so designed and fabricated to allow the linear light sources to rotate freely around the rod lens, the rod lens acting as a 'hinge pin', for the rotational positioning for the at least two light sources.

The optical system may include the linear light source containing at least two LED strips, each mounted to a heat dissipation surface, each heat dissipation surface angularly disposed to each other, and positioned along the same length of the cylinder, and each LED strip at a distance from the central axis of the lens so that the light emanating surface of each of the LEDs of each LED strips coincides with its associated focal distance, the angular disposition of the beams exiting the lens being equal to the angular disposition between the LED strips.

The optical system may include a light modifying element disposed along the rod lens and so positioned to receive and modify at least a portion of at least one beam exiting the cylindrical surface of the rod lens.

The optical system may include the light modifying element being mechanically attached to the LED strip so as to maintain optical alignment between the light emitted by the LEDs and the light modified by the light modifying element. The optical system may include the light modifying element being a refractor. The optical system may include the light modifying element being a reflector.

The optical system may include at least a portion of the rod lens RL fabricated to have a curved form factor, the LED also fabricated to have a curved form factor, the curvatures of the rod lens and the LED strips being concentric to each other to maintain a consistent focal distance between the light emanating surface on the LEDs and the central axis or the rod lens. The optical system may include each rod lens having the structural integrity to support the linear light sources connected to it.

The optical system may include the lighting system containing at least two rod lenses, each rod lens having at least one linear light source, the rod lenses connected to each other by connecting structural hardware disposed on least at one location along each of the rod lenses, the structural connecting hardware so designed and fabricated to accommodate elements for electrical continuity.

The optical system may include the rod lens providing the primary structural support for the light sources and attending opto mechanical components for the construction and fabrication of lighting products. The optical system may include the rod lenses being mechanically attached to form the structural frame for a lighting product. The optical system may include the structural support provided by a rod lens is to canter lever. The optical system may include the structural support provided by a rod lens is that of suspension.

Another embodiment of the invention provides an optical system for maximum light efficacy, light distribution and directional control comprising: A single refracting rod lens fabricated from substantially clear material and shaped as a solid cylinder, the rod lens having a central axis running central to the cylindrical surface of the cylinder, the rod lens having the power to focus and project light emanating from a linear light source as planar beam, the planar edge of the beam being parallel to the central axis of the rod lens; at least two linear light sources, each light source containing at least one strip of LEDS, each strip containing at least two LEDs, each strip mounted on heat dissipating material, the light sources so constructed as to substantially maintain the focal distance between the light emanating surface of the LEDs and the rod lens, each linear light sources positioned at different angles to each other around the rod lens so as to allow at least at least one LED from each of the linear light sources to occupy the same portion of the length the rod lens, allowing the light emanating from the said LEDs to be focused by the same length of the rod lens, the linear light sources at such an angle to each, so as to not to substantially obstruct light emanating from each strip of LEDs as well as the beams exiting the lens.

The optical system may include at least two of linear light sources that are positioned at different angles around the rod lens are attached side to side to each other and fabricated as a single unit. The optical system may include the linear light sources containing a mechanism to mechanically attach the linear light sources to the rod lens.

Yet another embodiment of the invention provides an optical system the optics of which having the capability of providing two distinct lighting functions simultaneously, comprising: a rod lens shaped as a solid cylinder substantially fabricated from clear material such as PMMA or glass, having a central axis; at least one linear light source containing an LED strip having at least one LED the LED strip mounted to a heat dissipating substrate, the linear light source disposed along a length of the rod lens, the linear light source containing a an attachment mechanism to connect the rod lens while maintaining the focal distance between the LEDs and the central axis of the rod lens, the attachment mechanism containing as mechanical element providing angular positioning of the linear light source around, and linear positioning along the length of the rod lens, at least one beam projecting light source disposed and positioned to project light to enter into one end of the rod lens, the rod lens functioning as a light guide guiding light through the rod lens.

The optical system may include the rod lens guides light entering from the projective light source and exits from the opposite end of the light guide.

BRIEF DESCRIPTION OF THE DRAWINGS

The present invention is illustratively shown and described in reference to the accompanying drawings, in which:

FIG. 1 A and 1B are respectively an edge view diagram and a partial side view diagram of the lighting system similar to the one shown in FIGS. 1 and 1A.

FIG. 1C is an end view diagram of a lighting system similar to that shown in FIGS. 1, 1A, and 1B further illustrating possible angles the linear light source can be positioned around the rod lens.

FIG. 4 is a simplified three dimensional diagram of an optical system containing a rod lens and a linear light source, having similar lighting functions as the optical system illustrated in FIG. 1.

FIGS. 4A, 44B, and 4C are three dimensional diagrams of an optical system containing a rod lens similar to the rod lens shown in FIG. 1, differing that there are two LED linear light sources, angularly disposed to each other, each positioned to at least partially share the same length of the same length of the rod lens.

DETAILED DESCRIPTION OF THE DRAWINGS

The present invention is introduced using examples and particular embodiments for descriptive purposes. Although a variety of examples are presented to show how various configurations can be employed to achieve the desired improvements, these particular embodiments are only illustrative and not intended in any way to restrict the inventions presented.

Preferred Embodiments

Figures 1, 1A, 1B:
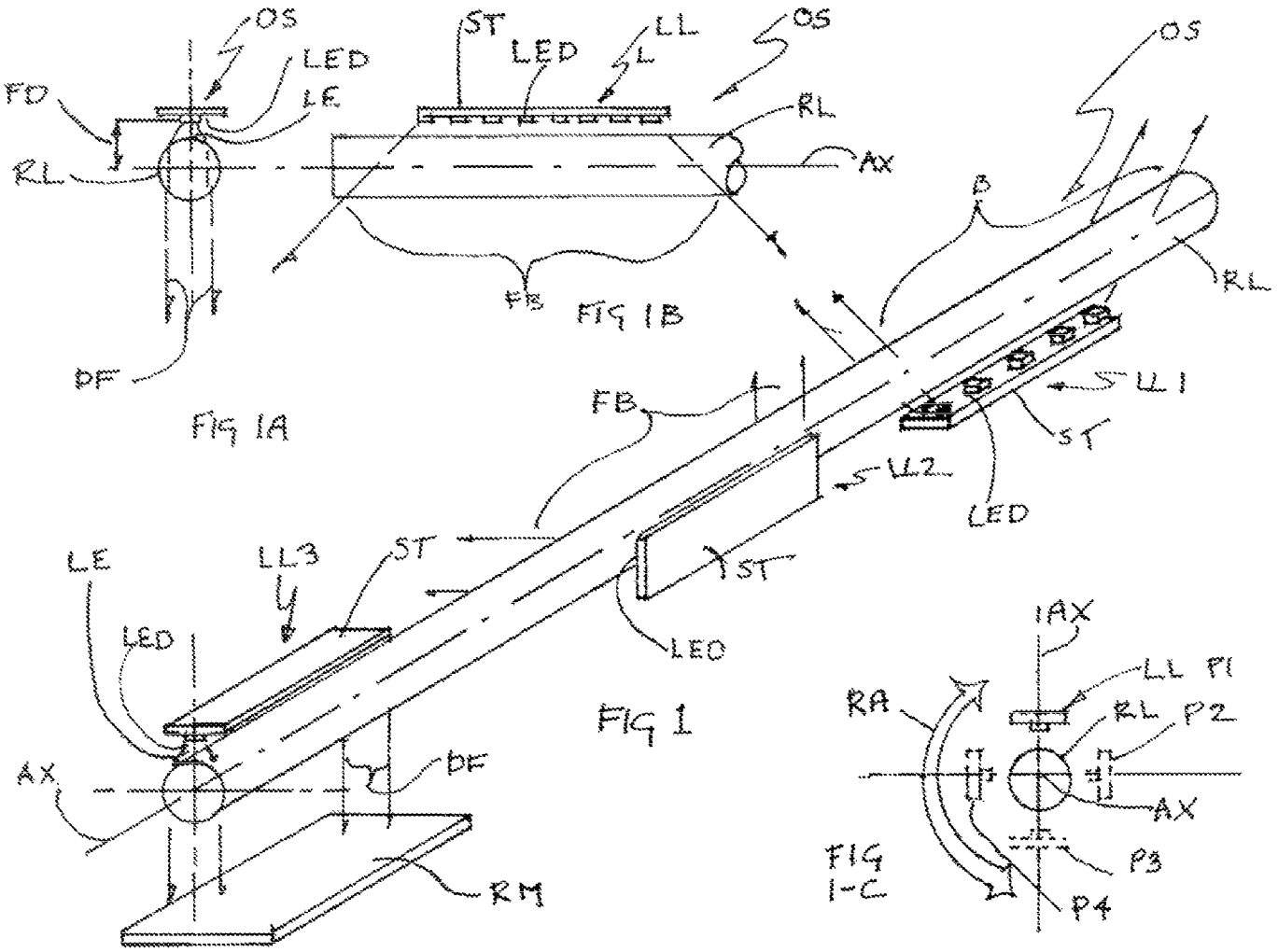
FIG. 1 is a three dimensional view of an optical system OS shown to contain two of its primary components. The first being a cylindrically shaped refracting optic further referred to as a rod lens RL. Rod lens RL can be fabricated from a clear material such as glass or PMMA and is disposed around a central optical axis AX.

FIG. 1 is a three dimensional view of an optical system OS shown to contain two of its primary components. The first being cylindrically shaped refracting optic further referred to as a rod lens RL. Rod lens RL can be fabricated from a clear material such as glass or PMMA and is disposed around a central linear optical axis AX.

The second component being a linearly shaped light source LL, in this embodiment there are three such light sources indicated as LL1, LL2, LL3, shown to be disposed at different locations along and parallel to rod lens RL, as well as at different radial positions d around the rod lens RL. Each of the three linear light sources LL1, LL2 and LL3 contain a strip of least one or more LED(s) LED, and each strip of LED(s) LED are shown to be mounted on a heat dissipating substrate ST.

The primary functions of the rod lens RL in respect to the light sources LL is both optical and structural.

The optical function of the rod lens having the power is to collect, focus and project light emanating from each of the multiple light sources as individual beams.

The structural function of the rod lens that of having structural integrity to span a specified distance and provide t support a predetermined number of light sources. The structural integrity of the rod lens can be determined by its length and the structural strength of material used to fabricate the rod it.

In detail the optical function of the rod lens is as follows: The linear light sources LL1, LL2, and LL3 are shown disposed parallel to the central axis AX at different locations along length of the rod lens RL, and each light source LL at different angular positions to each other around the optical axis AX. The optical function of the rod lens RL in relationship to the linear light sources LL1, LL2, and LL3 is for rod lens RL to collect, focus, and project light LE emanating from the LEDs contained within each of the light sources as a focused beam FB. The focus of beam FB has a single degree of freedom DF parallel to the central axis AX.

In some embodiments system OS could employ a light modifying element RM that either could be a refractor containing refractive material that changes the focus of focused beam FB, or a reflector containing reflective material that changes the direction of focused beam FB, as focused beam FB exits rod lens RL.

FIGS. 1A and 1B are respectively an edge view and side view diagram of an optical system OS similar to that shown in FIG. 1 further illustrating the function of rod lens RL to focus and project light emanating from LEDs LED as a focused beam FB having a focus in a single degree of freedom DF. The focused degree of freedom DF of focused beam FB is parallel to the central optical axis AX and the cylindrical surface of rod lens RL. Focal distance FD of rod lens RL is measured between light emanating surfaces LE of LEDs LED and the central optical AX. By altering the distance between Light sources LL and rod lens RL the divergence of focus of beam FB will be altered respectively.

FIG. 1C is an end view diagram of an optical system OS similar to that shown in FIGS. 1, 1A and 1B, further illustrating some of the possible angular positioning P1, P2, P3, and P4 of a typical linear light source LL around rod lens RL. Also illustrated is the potential for rod lens RL to rotate around its central axis AX, as indicated by rotation arrow RA.

Figure 2:
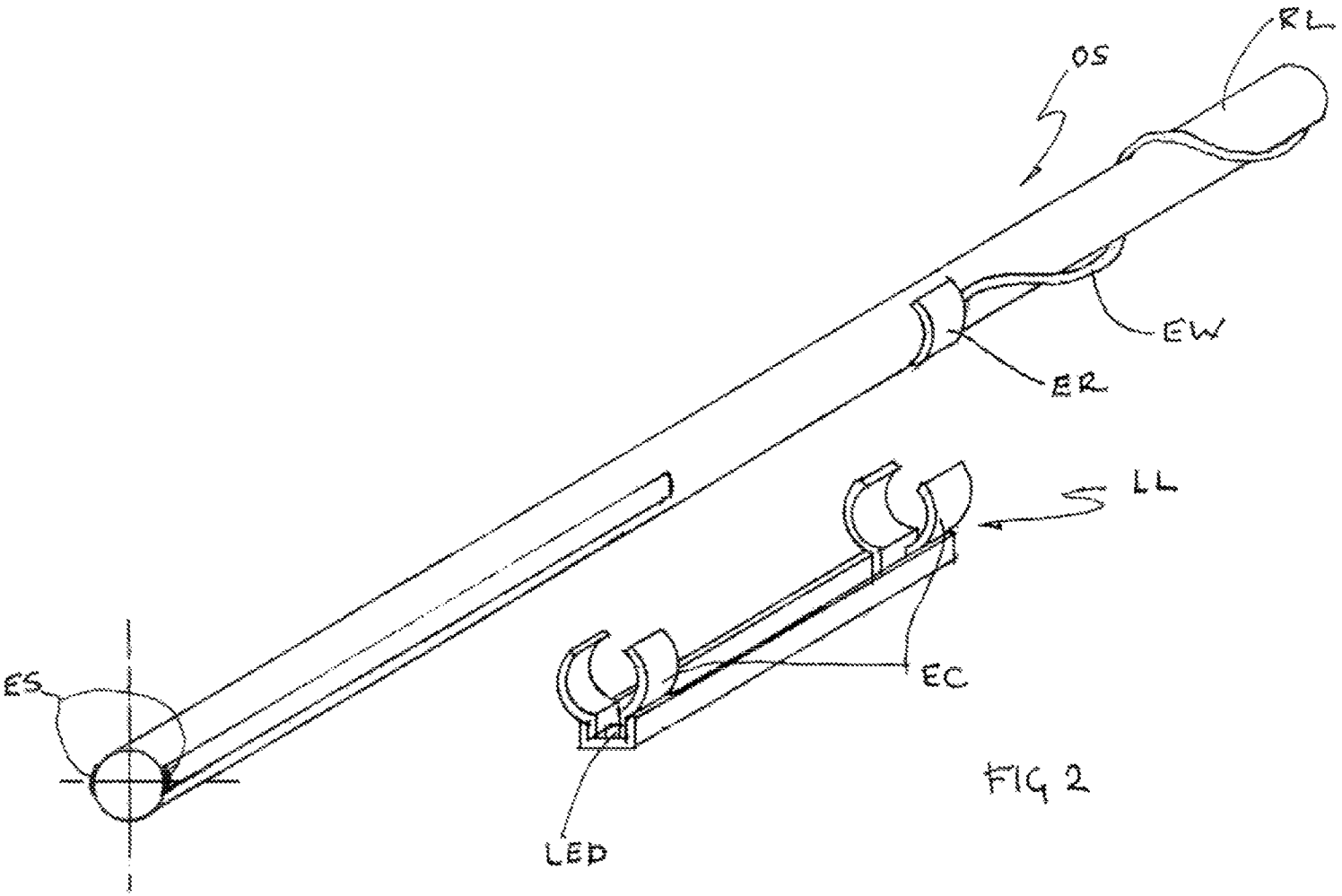
FIG. 2 is a three dimensional diagram of a lighting system containing similar optical components to the optical system shown in FIG. 1, further illustrating several types of electro mechanical components that can be employed in conjunction with the optical system.

FIG. 2 is a three dimensional view diagram of an optical system OS similar to that shown in FIG. 1, additionally having an electrical continuity and distribution system containing several types of electrically conductive elements, and electrically conductive attachment components which can be fabricated as part of linear light sources LL, can be employed to provide electrical continuity and mechanical connection between linear light sources LL and Rod lenses RL. Electrically conductive elements can include electrical wire EW disposed along the length of the rod lens RL, and or continuity strips ES which may comprise conductive tape or other conductive material such as conductive paint sprayed on or deposited along and or around the surface of rod lens RL. In this embodiment electrically conductive attachment components such as electrically conductive attachment clips EC can be fabricated, at least in part, from a spring material that exert a clamping and or a compressive force, and may at least in part, contain electrically conductive materials. Attachment clips can EC can be snapped onto rod lens RL. The compressive force exerted by attachment clips EC being strong enough to provide a secure engagement between the light sources LL and the rod lens RL, while not being so strong so as to allow the light sources LL to be rotationally positioned around rod lens RL, and allow for linear movement and positioning of the light sources LL along the length of the rod lens RL. Other types of electrically conductive attachment components can include electrically conductive ring clips ER which can be employed to secure electrical wire EW to rod lens RL, and to provide electrical continuity between wire EW and attachment clips EC.

In other embodiments electrical continuity to and between light sources LL can be achieved by a direct connection of wire to and between the Light sources LL, while not requiring electrical continuity of the attachment clips between the wire and the light sources LL.

Figures 3, 3A:
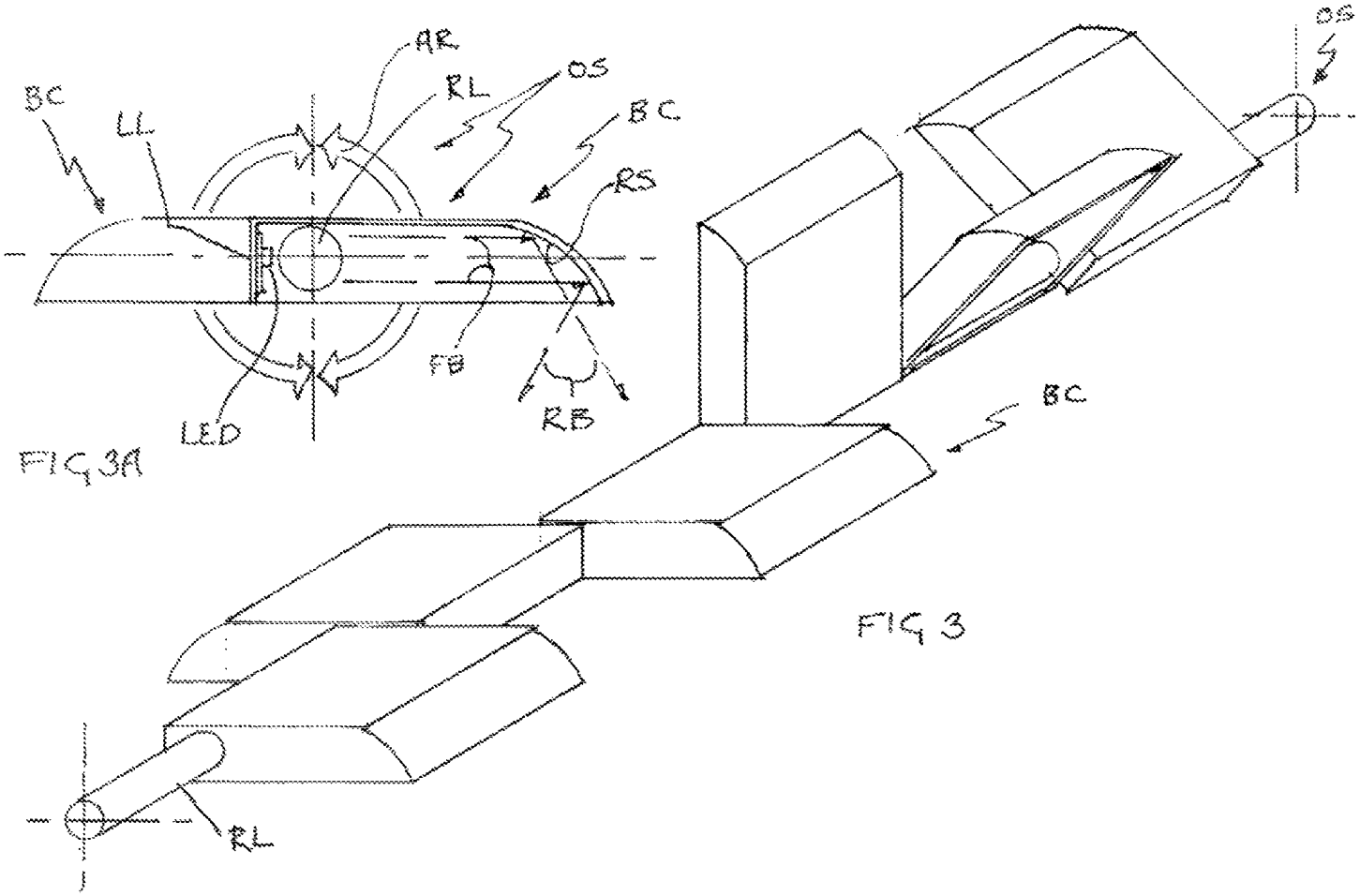
FIGS. 3 and 3A are respectively a three dimensional diagram and a sectional view diagram of a lighting system similar to that shown in FIG. 1 illustrating the addition of a reflective component.

FIGS. 3 and 3A are a three dimensional diagram and a sectional diagram of a an optical system OS similar to that illustrated in FIGS. 1 and 2, differing in that light sources LL is optically aligned and mechanically linked to reflector RS forming a composite beam directing component BC. In this embodiment beam directing components BC are shown to be disposed at various angles around rod lens RL and can be variably positioned in respect to each other as indicated by rotational arrows AR. The optical function of beam component BC is to redirect focused beam FB as reflected beam RB, and in other embodiments change the degree of focus of beam FP.

Figures 4, 4A, 4B:
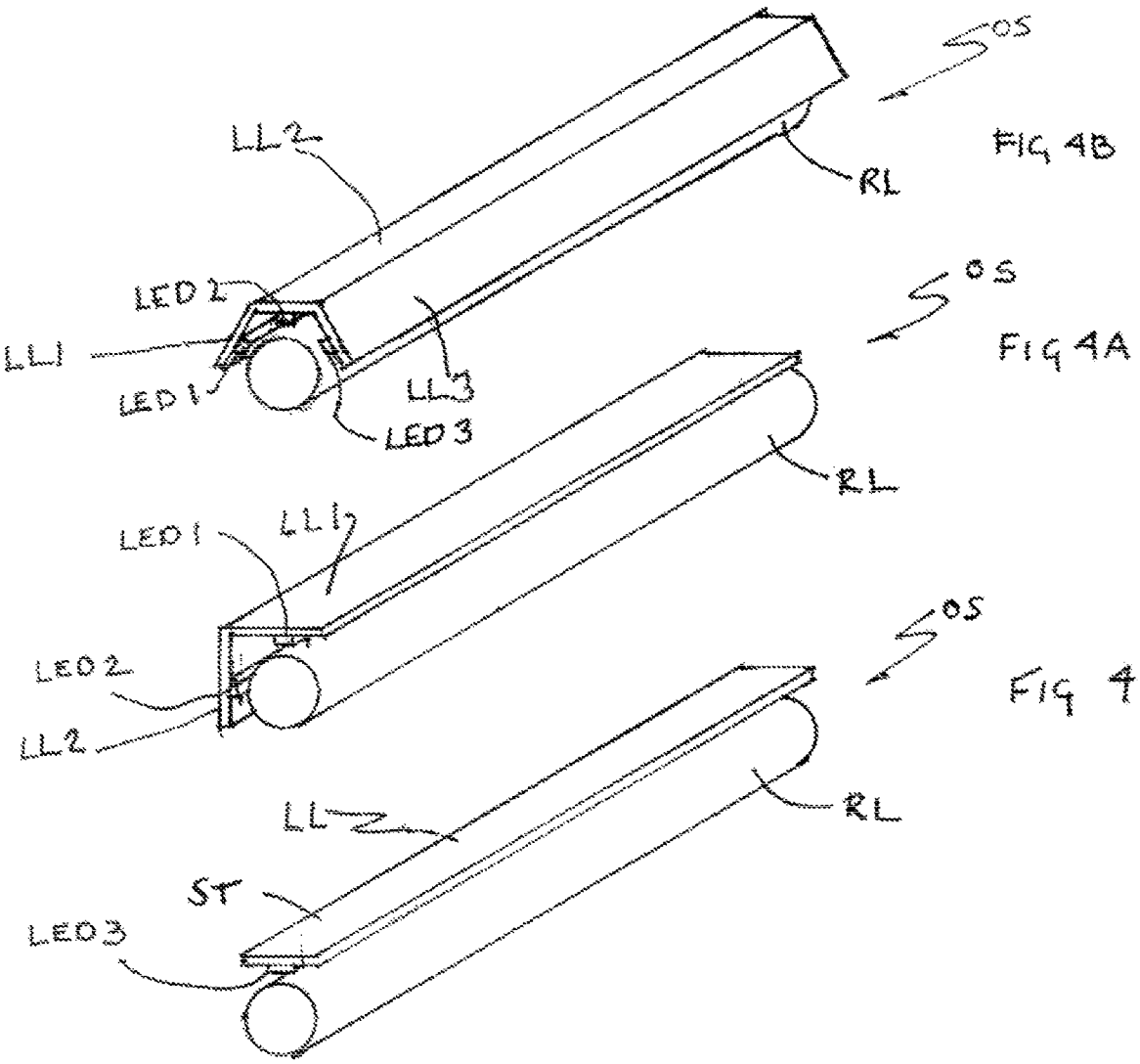

FIG. 4 is a simplified three dimensional view diagram of an optical system OS containing a rod lens RL and a linear light source LL, having all the lighting functions, and mechanical and electrical elements as those described in FIGS. 1 and 2.

Figure 4C:
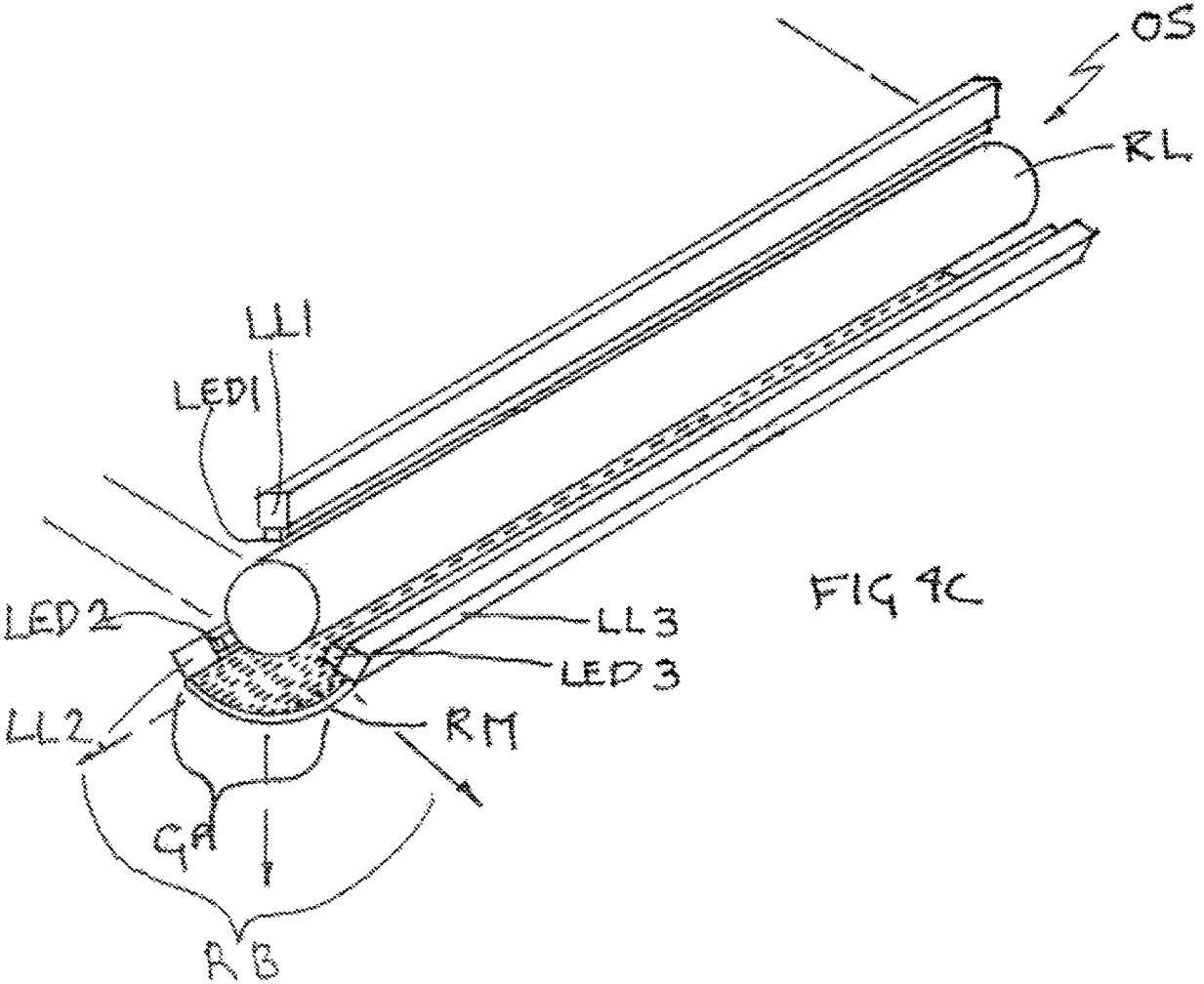

FIGS. 4A, 4B, and 4C are three dimensional diagrams of an optical system OS each having a rod lens RL, each having multiple linear light sources disposed at different angular positions to each other around the rod lens. In these embodiments: FIG. 4A illustrates a rod lens RL to have two linear light sources LL1 and LL2 angularly positioned at substantially 90 degrees to each other disposed around rod lens RL; FIG. 4B illustrates a rod lens RL to have three linear light sources LL1, LL2 and LL3 angularly positioned at substantially at 60 degrees to each other disposed around rod lens RL; FIG. 4C illustrates rod lens RL to have three linear light sources LL1, LL2, and LL3 angularly disposed substantially at 120 degrees to each other around rod lens RL, leaving a typical gap GA between the light sources LL1, LL2, and LL3 for projected beams projected by each of the light sources to pass between the other two opposing light sources. In this embodiment a refractive material RM is disposed in the gap GA between light sources LL2 and LL3, resulting in a modification of beam BP projected by light source LL1 as refracted beam RB.

Figure 5:
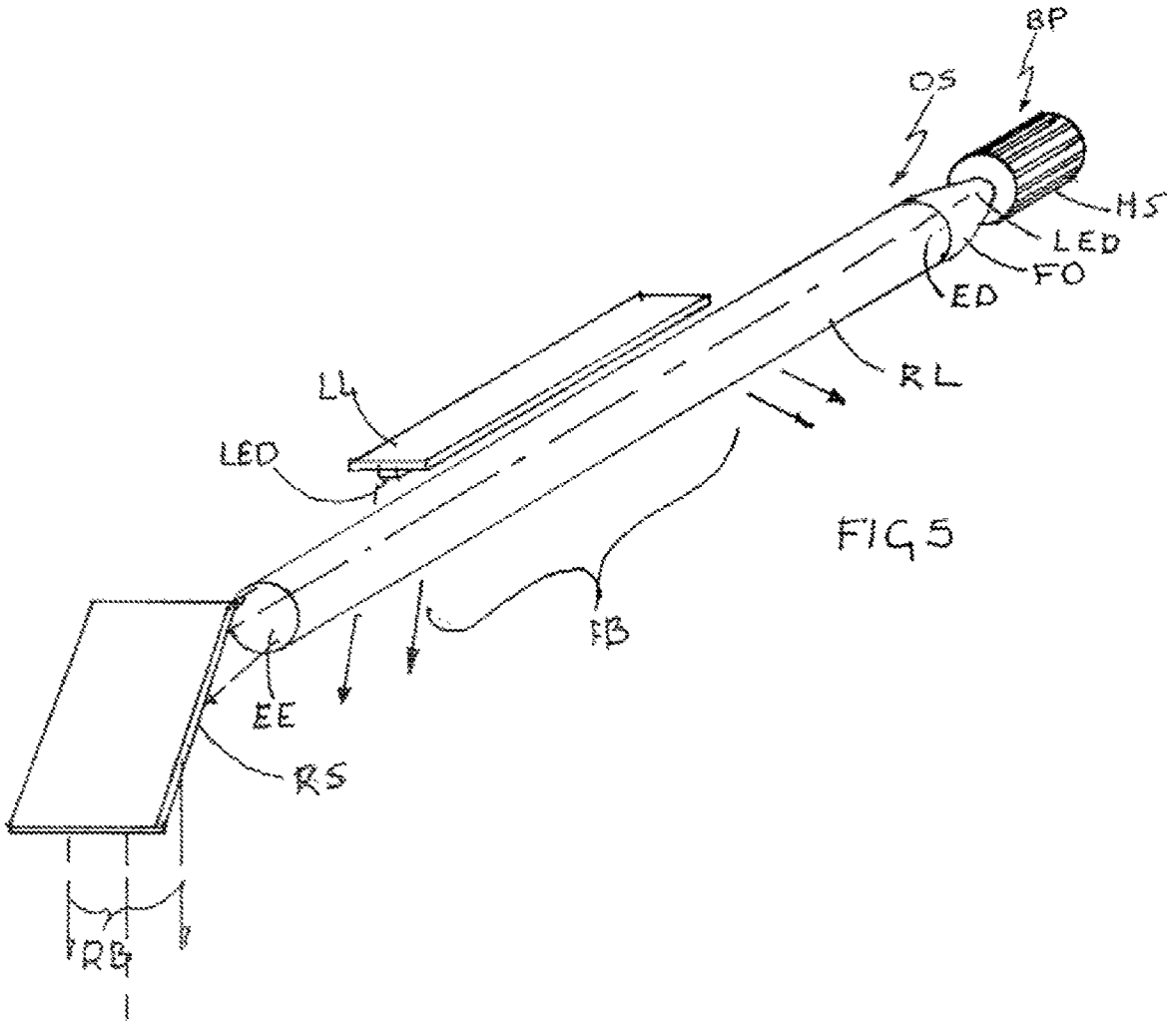
FIG. 5 is a three dimensional diagram of an optical system that provides two separate lighting functions.

FIG. 5 is a three dimensional diagram of an optical system OS employing a rod lens RL to provide two separate optical lighting functions simultaneously. One of these functions is to collect, focus and project light emanating from a linear light source LL as a planar beam. This function is fully explained in FIG. 1.

The other function rod lens RL is that of a light guide, which in this embodiment is guiding focused light from beam projector BP located at the light entry end ED of rod lens RL, through, and out the exit end EE of rod lens RL. In this embodiment the focused light is provided by a beam projecting device BP containing an LED mounted to a heat sink HS and a focusing optic FO such as a lens, parabolic or ellipsoidal reflector that focuses and projects light emanating from the LED. A reflector RS or other type of light modifying optic may be employed to modify light exiting the exit end EE of rod lens RL as reflected beam RB.

Figures 6, 6A, 6B, 6C:
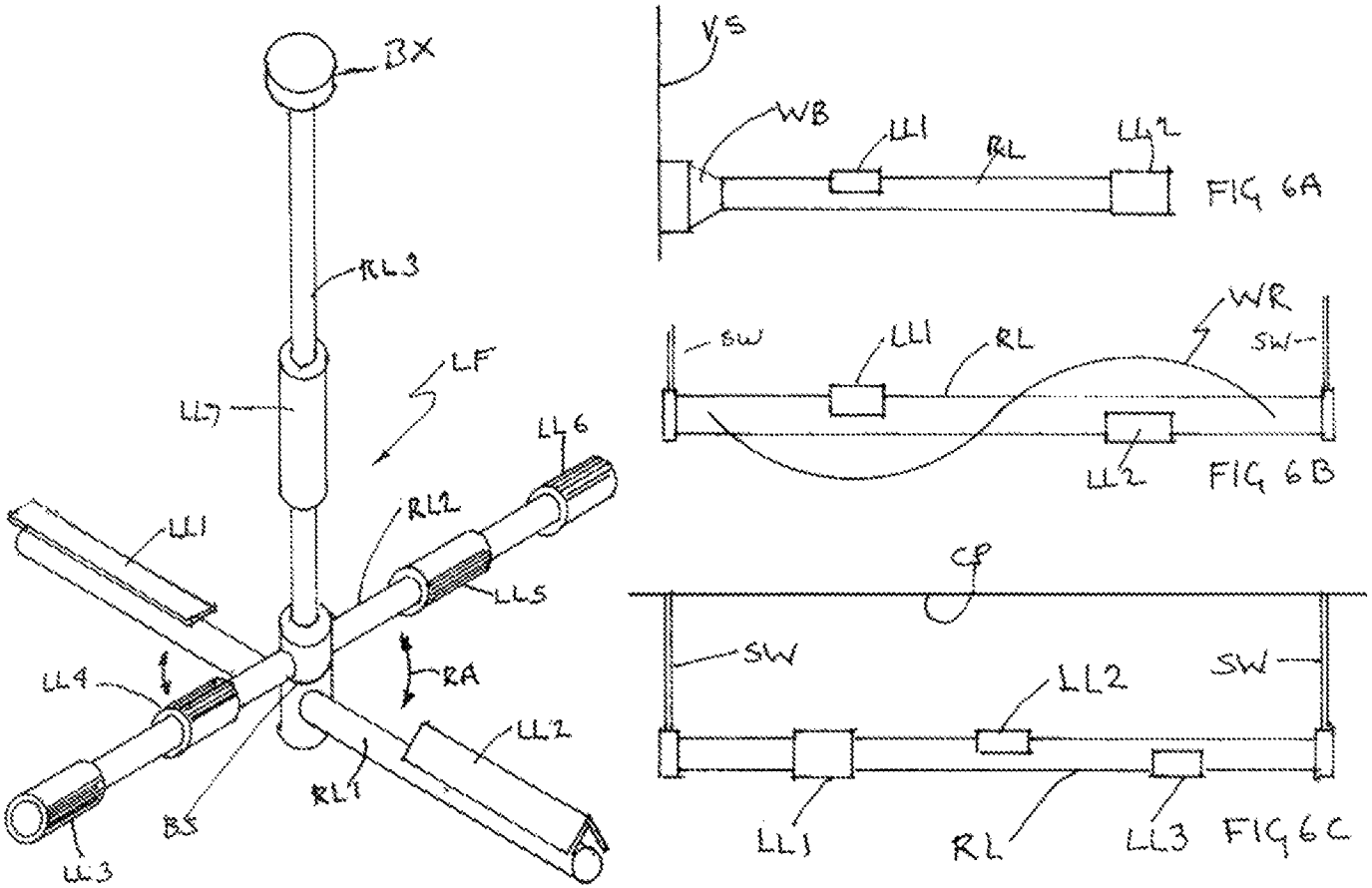
FIG. 6 is a three dimensional diagram of an example of a lighting fixture fabricated from optical and electro mechanical components shown in FIGS. 1 through 5, further illustrating the structural integrity and of the rod lens's system and span for multiple rod lenses to be configured to form a structural frame capable of supporting attending light sources and electro mechanical components.
FIGS. 6A, 6B and 6C are simplified side elevation view diagrams of examples of lighting fixtures that contain optical electromechanical components shown in FIGS. 1 through 5 further illustrating the structural integrity of the rod lenses.

FIG. 6 is a simplified three dimensional diagram of an example of a lighting fixture LF fabricated from components of the optical systems OS as illustrated in FIGS. 1 through 5, specifically: a first horizontally disposed rod lens RL1 onto which light sources LL1 and LL2 are attached; a second horizontally disposed rod lens RL2 onto which light sources LL3, LL4, LL5 and LL6 are attached; a vertically disposed rod lens RL3 onto which light source LL7 is attached. Rod lens RL3 from which rod lenses RL1 and RL2 are canter levered a function structurally suspend the lighting fixture LF from ceiling mounting box BX. Rotary connector BS located at the juncture of rod lens RL1 and rod lens RL2 connects and provides a rotary degree of freedom between the rod lenses as indicated by rotary arrows RA.

FIGS. 6A, 6B, and 6C are diagrams that illustrate examples of the structural integrity of individual rod lenses RL in relationship to the structure onto which the rod lenses RL are mounted, specifically: FIG. 6A illustrates horizontally disposed rod lens RL mounted via wall bracket WB onto vertical surface VS, rod lens RL performing a structural canter lever function. FIGS. 6B and 6C both illustrate horizontally disposed rod lenses RL suspended from above by suspension wires SW from ceiling plane CP, both rod lenses RL performing a structural bridging function. Besides illustrating the structural function of rod lens RL, FIG. 6B illustrates a refractive wave optic substantially spanning the Rod lens RL.

The present invention is illustratively described above in reference to the disclosed embodiments. Various modifications and changes may be made to the disclosed embodiments by persons skilled in the art without departing from the scope of the present invention as defined in the appended claims.

What is claimed is:

1. An optical system that can be employed in lighting products and lighting systems capable of distributing light in multiple directions from a single lens, the lens of having structural space spanning capabilities, comprising:

at least one rod lens;

at least one linear light source;

an electrical continuity and distribution system;

the at least one rod lens substantially fabricated from clear optical material and shaped in the form of a solid cylinder, the rod lens having an optical axis running central to the cylindrical surface, the function of the rod lens having the power to collect, focus, and project light emanating from the light source as a beam focused in a single degree of freedom, the focus of the beam being parallel to the central optical axis of the rod lens;

the at least one linear light source containing an LED strip having at least two LEDs mounted to a heat dissipation substrate, each linear light source disposed substantially parallel to the optical axis each linear light source containing an attachment component(s), the attachment component providing a secure attachment of the light source while allowing the light source to be placed at various positions around and along the length the rod lens;

the electrical continuity and distribution system containing conductive elements and electrically conductive attachment components, the electrical continuity and distribution system being designed to maintain electrical continuity to and between the linear light sources when the angular and linear positioning of the light sources are changed in respect to the rod lens.

2. An optical system as in claim 1 wherein the electrically conductive attachment component(s) of the linear light source(s) contains one or more clamping components constructed and arranged for allowing the linear light source(s) to be positioned around the central axis of the rod lens while maintaining the distance between the light emanating surface of the LEDs and the central axis of the rod lens while maintaining continuity between the conductive element and light source(s).

3. An optical system as in claim 1 wherein there are at least two linear light sources, each disposed at different positions along the length of the lens, the attachment component so designed and fabricated to allow the linear light sources to rotate freely around the rod lens, the rod lens acting as a 'hinge pin', for the rotational positioning for the at least two light sources.

4. An optical system as in claim 1 wherein the linear light source contains at least two LED strips, each mounted to a heat dissipation surface, each heat dissipation surface angularly disposed to each other, and positioned along the same length of the rod lens, and each LED strip at a distance from the central axis of the lens so that the light emanating surface of each of the LEDs of each LED strips coincides with its associated focal distance, the angular disposition of the beams exiting the rod lens being equal to the angular disposition between the LED strips.

5. An optical system as in claim 1 wherein there is a light modifying element disposed along the rod lens and so positioned to receive and modify at least a portion of at least one beam exiting the cylindrical surface of the rod lens.

6. An optical system as in claim 5 wherein the light modifying element is mechanically attached to the LED strip so as to maintain optical alignment between the light emitted by the LEDs and the light modified by the light modifying element.

7. An optical system as in claim 5 wherein the light modifying element is a refractor constructed and arranged for diffusing the beam exiting the rod lens.

8. An optical system as in claim 5 wherein the light modifying element is a reflector changing the direction of the beam exiting the rod lens.

9. An optical system as in claim 1 wherein at least a portion of the rod lens RL is fabricated to have a curved form factor, the LED strip also fabricated to have a curved form factor, the curvatures of the rod lens and the LED strips being concentric to each other to maintain a consistent focal distance between the light emanating surface on the LEDs and the central axis or the rod lens.

10. An optical system as in claim 1 wherein each rod lens has the structural integrity to support the linear light sources connected to it.

11. An optical system as in claim 1 wherein the lighting system contains at least two rod lenses, each rod lens having at least one linear light source, the rod lenses connected to each other by connecting structural hardware disposed on least at one location along each of the rod lenses, the structural connecting hardware so designed and fabricated to accommodate elements for electrical continuity between the rod lenses and the light sources.

12. An optical system as in claim 1 wherein the rod lens is configured to be outfitted with various types of mounting hardware for the purpose of installing the optical system as a lighting product for various lighting applications, the rod lens providing the primary structural support for the light sources, and components of the electrical continuity and distribution systems.

13. A lighting product as in claim 12 wherein there are multiple rod lenses at least two of which can be mechanically attached to each other forming a structural frame.

14. An optical system as in claim 12 wherein the mounting hardware includes a wall bracket from which the a rod lens is canter levered.

15. An optical system as in claim 12 wherein the mounting hardware includes a ceiling box from which the rod lens is vertically hung, the vertically hung rod lens structurally suspending the lighting fixture.

16. An optical system for maximum light efficacy, light distribution and directional control comprising:

A single rod lens fabricated from substantially clear material and shaped as a solid cylinder, the rod lens having a central axis running central to the cylindrical surface of the cylinder, the rod lens having the power to focus and project light emanating from a linear light source as planar beam, the planar edge of the beam being parallel to the central axis of the rod lens;

at least two linear light sources, each light source containing at least one strip of LEDS, each strip containing at least two LEDs, each strip mounted on heat dissipating material, the light sources containing an attachment component for a secure engagement with the rod lens and to maintain the focal distance between the light emanating surface of the LED and the rod lens, each linear light sources positioned at different angles to each other around the rod lens so as to allow at least at least one LED from each of the linear light sources to occupy the same linear portion of along the length the rod lens, allowing the light emanating from the said LEDs to be focused by the same linear portion along the length of the rod lens, the linear light sources at such an angle to each, so as to not to substantially obstruct light emanating from each strip of LEDs as well as the beams exiting the lens.

17. An optical system as in claim 16 wherein there are at least two of linear light sources that are positioned at different angles to each other around the rod lens, and are fabricated side to side as a single unit.

18. An optical system as in claim 16 wherein the linear light sources contain an attachment component mechanism to mechanically attach the linear light sources to the rod lens.

19. An optical system the optics of which having the capability of providing two distinct lighting functions simultaneously, comprising:

a rod lens shaped as a solid cylinder substantially fabricated from clear material such as PMMA or glass, having a central axis;

at least one linear light source containing an LED strip having at least one LED the LED strip mounted to a heat dissipating substrate, the linear light source disposed along a length of the rod lens, the linear light source containing a an attachment component that clamps the linear light source at a specified distance from the rod lens maintaining the focal distance between the LEDs and the central axis of the rod lens, the clamping force exerted by the attachment component providing a secure angular positioning of the linear light source around, and linear positioning along the length of the rod lens;

At least one beam projecting light source disposed and positioned to project light into one end of the rod lens, the rod lens functioning as a light guide guiding light through the rod lens.

20. An optical system as in claim 19 wherein the rod lens guides light guide entering from the projective light source exits from the opposite end of the light guide.

* * * * *